US008891345B2

(12) United States Patent
Ehrlund

(10) Patent No.: US 8,891,345 B2
(45) Date of Patent: Nov. 18, 2014

(54) ELECTRO ACOUSTIC TRANSDUCER

(76) Inventor: Göran Ehrlund, Stora Skedvi (SE)

( * ) Notice: Subject to any disclaimer, the term of this patent is extended or adjusted under 35 U.S.C. 154(b) by 49 days.

(21) Appl. No.: 13/508,879

(22) PCT Filed: Nov. 10, 2010

(86) PCT No.: PCT/SE2010/051236
§ 371 (c)(1),
(2), (4) Date: May 9, 2012

(87) PCT Pub. No.: WO2011/059384
PCT Pub. Date: May 19, 2011

(65) Prior Publication Data

US 2012/0230523 A1 Sep. 13, 2012

(30) Foreign Application Priority Data

Nov. 10, 2009 (SE) ..... 0950847

(51) Int. Cl.
*H04R 25/00* (2006.01)
*H04R 19/04* (2006.01)

(52) U.S. Cl.
CPC ..... *H04R 19/04* (2013.01)
USPC ..... 369/174; 381/369

(58) Field of Classification Search
CPC ..... H04R 19/016
USPC ..... 381/369, 174
See application file for complete search history.

(56) References Cited

U.S. PATENT DOCUMENTS

| | | | | |
|---|---|---|---|---|
| 4,776,019 | A * | 10/1988 | Miyatake | 381/174 |
| 6,678,383 | B2 * | 1/2004 | Ito et al. | 381/174 |
| 7,062,058 | B2 * | 6/2006 | Steeman et al. | 381/369 |
| 7,620,191 | B2 * | 11/2009 | Tanabe et al. | 381/174 |
| 8,121,315 | B2 * | 2/2012 | Song et al. | 381/174 |
| 8,144,898 | B2 * | 3/2012 | Feng | 381/174 |
| 2007/0258605 | A1 * | 11/2007 | Tsuchiya | 381/174 |

OTHER PUBLICATIONS

Canadian Official Action dated Dec. 13, 2013, from corresponding Canadian application 2779176.

* cited by examiner

*Primary Examiner* — Curtis Kuntz
*Assistant Examiner* — Ryan Robinson
(74) *Attorney, Agent, or Firm* — Browdy and Neimark, PLLC

(57) ABSTRACT

A condenser microphone element is disclosed with an electrically conducting transducer membrane having an acoustically active area arranged to receive sound waves and to vibrate in response to the sound waves. The membrane is arranged in parallel with and at a distance from a back plate, which is formed from a non-conductive base. The base is provided with a conductive layer. The conductive layer has an active area that is arranged opposite the acoustically active area of the membrane and has a shape that faces the acoustically active area, and is delimited by an area where no conductive layer is provided. A microphone including the condenser element and a method of producing the microphone element are also provided.

9 Claims, 4 Drawing Sheets

ELECTRO ACOUSTIC TRANSDUCER

FIELD OF THE INVENTION

The present invention relates to an electro acoustic microphone element and in particular to a condenser microphone element for transformation of sound waves into an electric signal. Further, the invention relates to an electro acoustic microphone including such an element, and to a method of producing the microphone element.

BACKGROUND

Condenser microphones span the range from telephone transmitters, karaoke microphones to high fidelity recording microphones. In a condenser microphone, also known as a capacitor or electrostatic microphone, a diaphragm or membrane acts as one plate of a capacitor, and the vibrations caused by sound waves produce changes in the distance between the membrane and the other plate; the back plate. A polarizing voltage is applied over the two plates, and the capacitance change provides the output from the device.

Throughout the prior art, the transducer membranes used are predominantly of circular shape. One example of a condenser microphone with a non circular membrane is shown in U.S. Pat. No. 3,814,864 wherein the diaphragm is broken up into many small pieces so that each attains a natural high frequency resonance above the range of sounds to be picked up with the sum total of the pieces providing an output as great as a single diaphragm with a lower impedance. This is achieved by providing a series of concentric ring contacts with a diaphragm stretched over the rings, the highest points or ridges of which lie on a convex surface, to break up the diaphragm into annular sections.

In WO2007/004981 a condenser microphone with a triangular transducer membrane and a corresponding back plate is disclosed. The back plate of this microphone consists of a solid machined copper plate, which is expensive to manufacture.

SUMMARY OF THE INVENTION

An object of the invention is to provide a condenser microphone element that is reliable and which provides a cost efficient alternative to prior art condenser microphones. This object is achieved by the claimed condenser microphone element, condenser microphone and method.

According to a first aspect the invention relates to a condenser microphone element with an electrically conducting transducer membrane having an acoustically active area that is arranged to receive sound waves and to vibrate in response to said sound waves, wherein the membrane is arranged in parallel with and at a distance from a back plate, which is formed from a non conductive base, which is provided with a conductive layer. The conductive layer has an active area that is arranged opposite the acoustically active area of the membrane and has a shape that faces said acoustically active area, and is delimited by an area where no conductive layer is provided.

In one specific embodiment of the invention the area where no conductive layer is provided is a gap, wherein a conductive layer is provided both outside and inside of said gap.

In another specific embodiment of the invention the acoustically active area of the membrane is larger than the active area of the back plate.

In yet another specific embodiment of the invention the membrane is connected to ground and kept at potential 0 V.

In another specific embodiment of the invention a spacer in the form of an adhesive film is attached to the upper surface of the back plate to create the necessary distance between the active area of the back plate and the acoustically active area of the membrane.

In yet another specific embodiment of the invention the acoustically active area of the transducer membrane has an essentially triangular shape.

In another specific embodiment of the invention an electrical connection is arranged through the non conductive base of the back plate, which connection connects the active area of the back plate to an electrical contact.

In a further embodiment of the invention the non conductive base is formed from a rigid material from the group of materials comprising ceramics, plastics and composites.

In another specific embodiment of the invention the conductive layer is a metallic layer that includes copper.

According to a second aspect the invention relates to a condenser microphone that comprises a condenser microphone element according to any of the embodiments described above.

According to a third aspect the invention relates to a method of producing a condenser microphone element including an electrically conducting transducer membrane having an acoustically active area arranged in parallel with and at a distance from a back plate, wherein the back plate is formed from a non conductive base, which is provided with a conductive layer. The method is unique in that the back plate is formed in the same way as a printed circuit board is produced, by adding a conductive layer in form of metal foil to a non conductive base, wherein the conductive layer is formed with an active area that is to be arranged opposite the membrane, such that it faces the acoustically active area of the membrane, and is delimited by an area where no conductive layer is provided.

The inventive condenser microphone element provides a product that has better characteristics than most sophisticated products on the market. Further, the method of producing the inventive product is much simpler and much more cost effective than conventional methods. Hence the products and the method according to the independent claims clearly fulfill the object set out for the invention.

Advantageous embodiments of the invention are defined in the dependent claims and in the detailed description.

DETAILED DESCRIPTION OF THE INVENTION

Figure 1A:
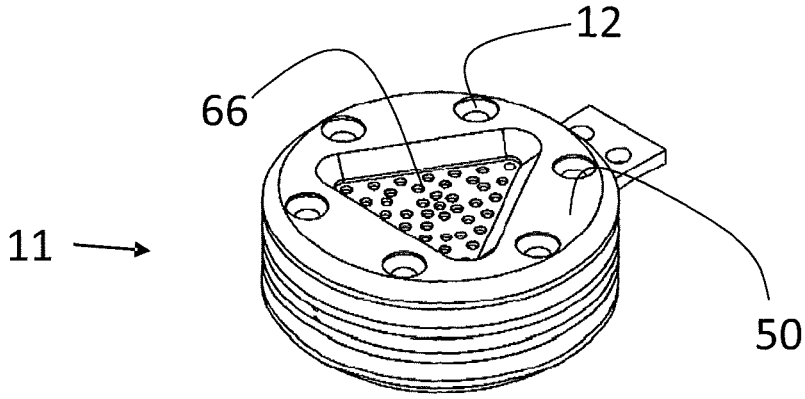
FIG. 1*a* shows a perspective view of one embodiment of a microphone element according to one embodiment of the present invention, with the membrane removed.
Figure 1B:
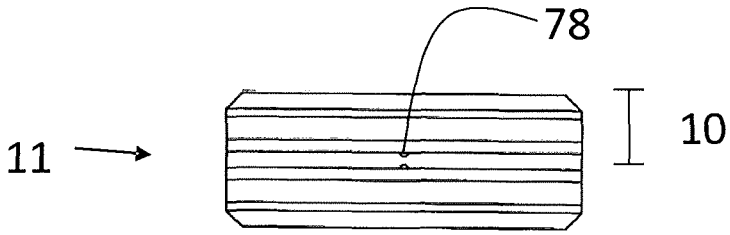
FIG. 1*b* shows a side view of a microphone element according to FIG. 1*a*.
Figure 1C:
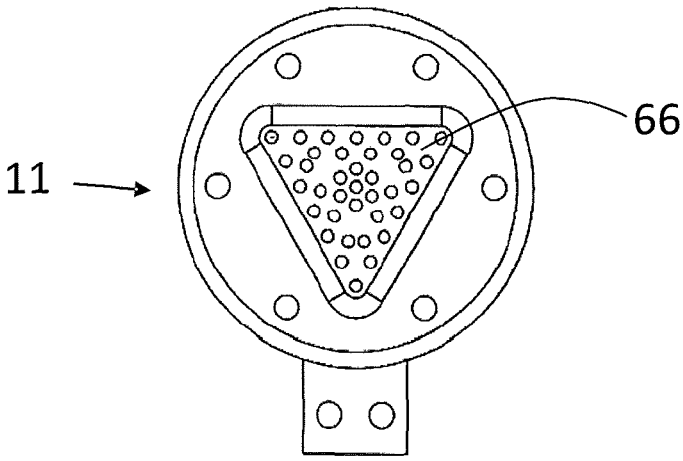
FIG. 1*c* shows a top view of a microphone element according to FIG. 1*a*.

FIGS. 1*a* to 1*c* show different views of an embodiment of a dual microphone capsule or element 11 according to the present invention. The dual element comprises two lids 50, one at each end of the element 11. The upper lid has an opening 55 through which an active surface or area 66 of a back plate appears. Normally, a membrane would hinder the view of the back plate, but in FIGS. 1*a* and 1*c* the membrane has been left out for explanatory reasons. Further the element 11 comprises through holes 12, through which screws are inserted in order to hold the parts together.

Figure 2:
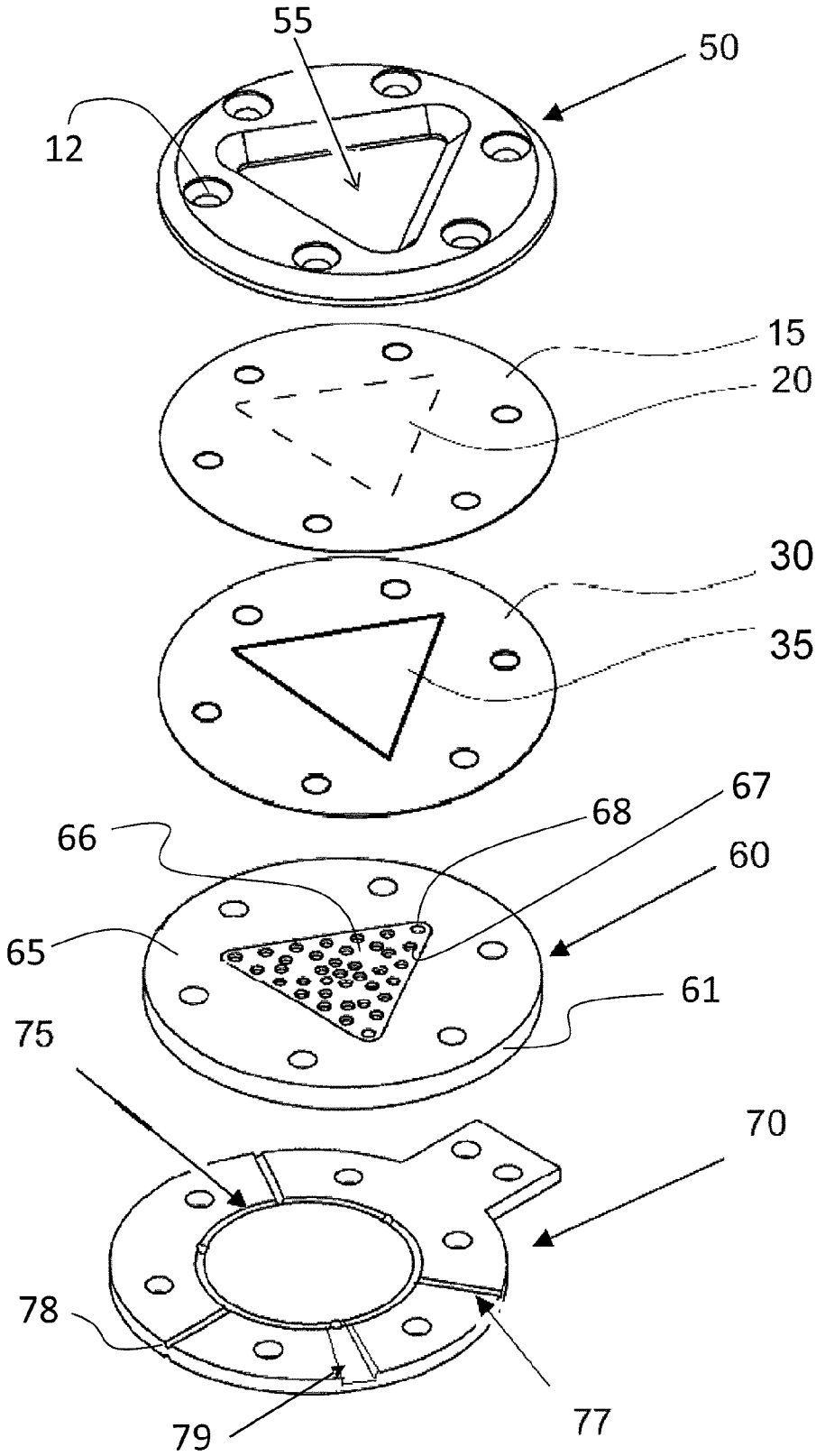
FIG. 2 shows an exploded view of half of the microphone element of FIG. 1.

FIG. 2 shows an exploded view of a single condenser microphone element 10, corresponding to the top part of FIG. 1. As indicated above, the condenser microphone element 10 comprises a lid 50 with a membrane opening 55 that defines the shape of the acoustically active area 20 of the transducer membrane 15, the membrane being placed immediately under the lid 50. The acoustically active area 20 is defined as the free portion of the membrane 15, i.e. the part that is not clamped but is free to vibrate in response to incoming sound waves.

Below the transducer membrane 15 an electrically isolating frame 30 with a corresponding membrane opening 35 is placed, such that the membrane 15 is clamped between the lid 50 and said frame 30. The isolating frame 30, also known as condenser gap, makes sure that the membrane 15 is kept at a certain distance from an opposed electrode surface 66 arranged on a non conductive back plate 60. The back plate 60 comprises a triangular electrode surface 66, with a shape that corresponds to the shape of the active membrane area 20.

The precision of the isolating frame 30 is very important. Preferably, it has a width of between 200 and 400 μm, which width gives rise to a satisfying level of capacitance between the membrane 15 and the electrode surface 66. In a specific embodiment of the invention the isolator frame consists of spacer in the form of an adhesive film of the desired width that is attached to the upper surface of the back plate.

The capacitance is inversely proportional to the distance between the membrane 15 and the electrode surface 66. In order for the membrane 15 to vibrate in response to sound waves hitting it from the outside, the air on the inside of the membrane must be allowed to escape from the space between the membrane and the back plate 60. Therefore, the back plate 60 comprises attenuation recesses 67 and vent holes 68. There may be fewer or more holes, for instance there may be through holes through the centre of the back plate 60.

The element 11 in FIG. 1 comprises two condenser microphone elements 10 constructed according to above, each comprising a back plate 60 arranged with its bottom surface against a mounting plate 70. In order to provide pressure equalizing, the mounting plate 70 comprises pressure equalization grooves 75 that are in fluidic contact with the cavity between each membrane 15 and its corresponding back plate 60, via one or more vent holes 68 extending through the back plate 60. In the assembled state the vent holes 68 are aligned with the pressure equalization grooves 75 in the mounting plate 70. The pressure equalization grooves 75 in the mounting plate 70 are connected to radial grooves 77 that are in communication with the ambient pressure via openings 78, which is visible in FIG. 1. According to the embodiment shown in FIG. 2, the attenuation recesses situated at the corners of the triangular electrode surface 66 are through holes that functions as vent holes 68.

As is shown in FIG. 2 the acoustically active area 20 of the transducer membrane 15 is of an essentially triangular shape, which has been found to give a remarkably improved sound reproduction. The expression essentially triangular shape comprises all types of triangles, even if the disclosed preferred embodiment is an equilateral triangle. Moreover, the expression comprises triangular shapes with concave curved sides or convex curved sides. Other possible embodiments comprise triangles with rounded alternatively cut corners, recesses from one or more of the sides and possible combinations of any of these.

Figure 3A:
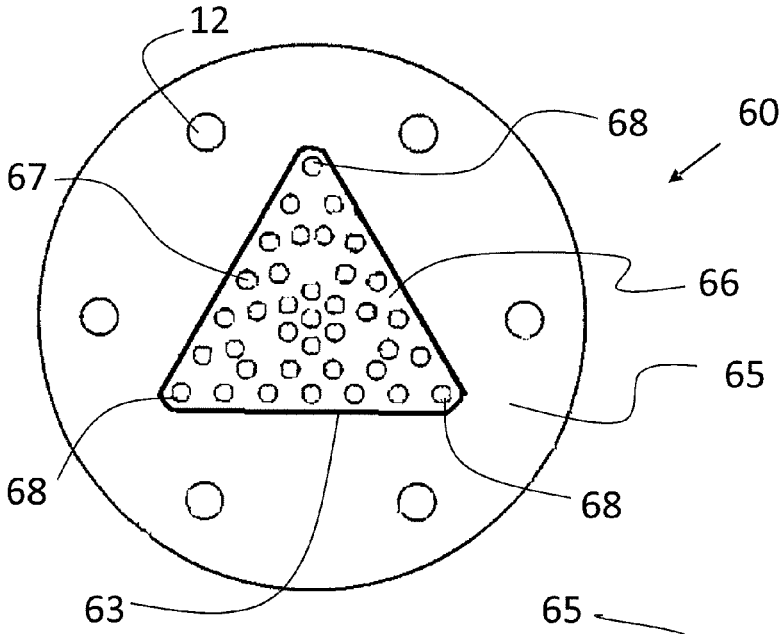
FIGS. 3*a*, 3*b*, and 3*c* schematically show a back plate according to the present invention from above, from below, and from the side, respectively.
Figure 3C:
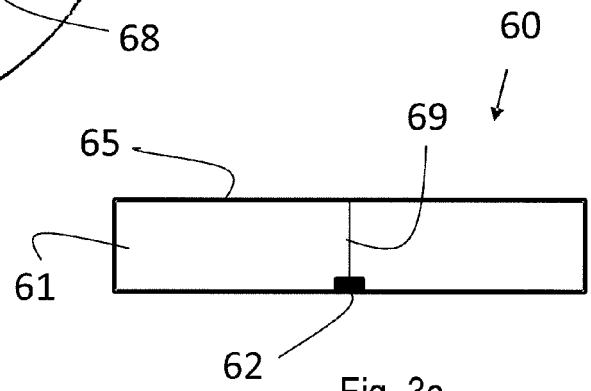
Figure 3B:
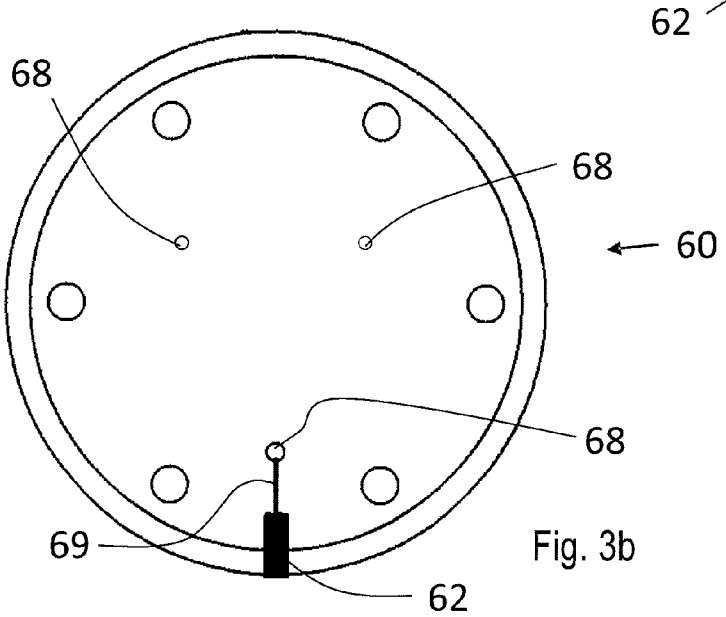

In FIGS. 3*a*-3*c* an embodiment of the back plate 60 according to the invention is schematically shown. In contrast to prior art back plates, the back plate 60 according to the invention is formed from a non conductive base 61, which is provided with a conductive layer 65, the layer having an active area 66 that is to be arranged opposite the membrane 15 in the assembled state. The non conductive base 61 may be formed from basically any non conductive material, such as e.g. plastics, ceramics or composites, as long as it is stiff enough to withstand the efforts and may be made plane enough. In a first embodiment the non conductive base 61 is formed from fiberglass, upon which a metallic layer 65 is added. The metallic layer may in itself consist of several layers, for instance a first layer of copper may be added upon which a layer of nickel and, as the outer layer, gold is added.

Generally, the back plate may be produced in the same manner as a printed circuit board is produced. Hence, conducting layers are typically made of thin copper foil, whereas insulating layers dielectric are typically laminated together with epoxy resin prepreg. The board is typically coated with a solder mask that is green in color. Other colors that are normally available are blue and red. There are quite a few different dielectrics that can be chosen to provide different insulating values depending on the requirements of the circuit. Some of these dielectrics are polytetrafluoroethylene (Teflon), FR-4, FR-1, CEM-1 or CEM-3. Well known prepreg materials used in the PCB industry are FR-2 (Phenolic cotton paper), FR-3 (Cotton paper and epoxy), FR-4 (Woven glass and epoxy), FR-5 (Woven glass and epoxy), FR-6 (Matte glass and polyester), G-10 (Woven glass and epoxy), CEM-1 (Cotton paper and epoxy), CEM-2 (Cotton paper and epoxy), CEM-3 (Woven glass and epoxy), CEM-4 (Woven glass and epoxy), CEM-5 (Woven glass and polyester).

Just as the vast majority of printed circuit boards the back plate 60 may be made by bonding a layer of copper over the entire substrate, then removing unwanted copper after applying a temporary mask (e.g. by etching), leaving only the desired copper traces. The back plate may also be made by adding traces to the bare substrate (or a substrate with a very thin layer of copper) usually by a complex process of multiple electropolating steps.

There are three common "subtractive" methods (methods that remove copper) used for the production of printed circuit boards, and which may equally be used for the production of the inventive back plate 60:

Silk screen printing uses etch-resistant inks to protect the copper foil. Subsequent etching removes the unwanted copper. Alternatively, the ink may be conductive, printed on a blank (non-conductive) board. The latter technique is also used in the manufacture of hybrid circuits.

Photoengraving uses a photomask and chemical etching to remove the copper foil from the substrate. The photomask is usually prepared with a photo plotter from data produced by a technician using CAM, or computer-aided manufacturing software. Laser-printed transparencies are typically employed for phototools; however, direct laser imaging techniques are being employed to replace phototools for high-resolution requirements.

PCB milling uses a two or three-axis mechanical milling system to mill away the copper foil from the substrate. A PCB milling machine (referred to as a 'PCB Prototyper') operates in a similar way to a plotter, receiving commands from the host software that control the position of the milling head in the x, y, and (if relevant) z.

"Additive" processes may also be used. The most common is the "semi-additive" process. In this version, the unpatterned substrate has a thin layer of copper already on it. A reverse mask is then applied. (Unlike a subtractive process mask, this mask exposes those parts of the substrate that will eventually become the traces.) Additional copper is then plated onto the board in the unmasked areas; copper may be plated to any desired weight. Tin-lead or other surface platings are then applied. The mask is stripped away and a brief etching step removes the now-exposed original copper laminate from the board, isolating the individual traces.

Thus, the forming of conductive metallic layers on non metallic layers is in itself not novel to a skilled person and is therefore not discussed in detail in this description. In the application of back plates in condenser microphones it is uttermost important that the surface of the plate is absolutely planar. Hence, it is important that the surfaces of the base, and in particular the surface to be plated, is absolutely planar. This may be achieved by the methods mentioned above.

In the embodiment shown in FIG. 3*a* generally the whole upper surface of the back plate is covered by a metallic layer, with the exception for a conductive gap 63 in the form of a triangle where there is no conductive layer is formed. This gap 63 defines the active area 66 of the layer 65. The gap 63 may e.g. be formed by etching in accordance with the corresponding of the processes described above. There are however other ways of forming isolating portions according to other discussed processes.

Also, instead of a just gap 63, all parts of the back plate 60 that are exterior of the active area 66 may include no conductive layer 65. An important feature of the invention is that the active area 66 of the layer 65 corresponds to the acoustically active area 20 of the membrane 15, i.e. the portion of the membrane that is not clamped, but is free to vibrate. However, the active area 66 of the back plate 60 may be smaller than the acoustically active area 20 of the membrane 15, such that only part of the acoustically active area 20 of the membrane 15 is electrically active. The active area 66 of the back plate 60 should hence not be bigger than or go outside the acoustically active area 20 of the membrane 15, in order to avoid interference in the signal residing from the clamped part of the membrane 15.

In a preferred embodiment this is achieved by forming a gap, which may or may not correspond to the conductive gap 63 described above, and which creates a substantially uniform gap along and inside the edge of the acoustically active area 20 of the membrane 15. The shape of the active area 66 of the back plate 60 is not crucial, such that it may be substantially smaller than the acoustically active area 20 of the membrane 15. However, the output signal from the microphone element 11 will depend on the size of the active area 66 of the back plate 60 and therefore the power of the output signal will be proportional to the size of the active area 66. For that reason the active area 66 of the back plate 60 should be as big as possible.

Depending on whether the edges of the back plate 61 i.e. the parts outside the active area 66, is covered with a conductive layer or not the thickness isolating frame 30 will have to be adjusted. If the edges of the back plate 61 are covered with a conductive layer the distance between the membrane and the active area 66 of the back plate 60 will correspond directly to the width of the isolating frame 30, which may be an advantage due to the simplicity of producing a desired distance. If the edges are not covered, the isolating frame 30 needs to be correspondingly thicker in order to achieve the same distance between the membrane and the active area 66 of the back plate 60. Either way, the isolating frame 30 may consist of an adhesive film that may be fastened to the back plate 60 or of a separate rigid spacer element of e.g. a plastic material.

Further, a thin isolation edge of about 3 mm, where no conductive layer is added, is preferably formed around the screw holes 12, such that the non-active part of the conductive layer is not in contact with the screws (not shown). Namely, the screws are in contact with the lid and the membrane 15, which are both connected to ground, i.e. kept at potential 0 V. Hence, if the non-active part of conductive layer 65 would be in contact with the screws there would be a difference in potential between the active part 66 of the conductive layer 65 and the non-active part of the conductive layer 65, which difference in potential would affect the capacitance and thus the sensitivity of the microphone negatively.

In FIG. 3*b* the back side of the back plate 60 is shown. As is visible the back side involves a contact 62 for connection to a power source. The contact 62 is connected to a corner of the active area 66 of the conductive layer 65 via a connection 69, which runs through the back plate 60, close to one of the vent holes. The contact 62 is preferably formed in the same manner as the conductive layer on the upper side of the back plate 60. As an alternative to the connection 69, the contact may be arranged in connection to the upper side of the back plate 60, wherein a connection formed by a string of conductive layer may be arranged on the upper side out to said connection. There is however an advantage of the arrangement shown in FIGS. 3*a-c* in that the interference is thereby kept at a minimum.

Further, the electrode surface 66 of the back plate 60 is provided with a plurality of attenuation recesses 67 arranged in a pattern below the acoustically active area 20 of the transducer membrane 15. The attenuation recesses 67 are provided to reduce the effect of transverse flow of air in the condenser gap, and to provide controlled attenuation of the membrane 15. According to one embodiment, the attenuation recesses 67 are bore holes of a pre-defined depth in the back plate 60, the recesses 67 may be of equal depth, or the depths can be individually adapted to provide desired characteristics of the registered sound. As indicated above the conductive layer is added to vent holes 68 or recesses 67, such that the active area 66 of the conductive layer has no variations in depth that otherwise would infect the microphone element adversely.

Figure 4:
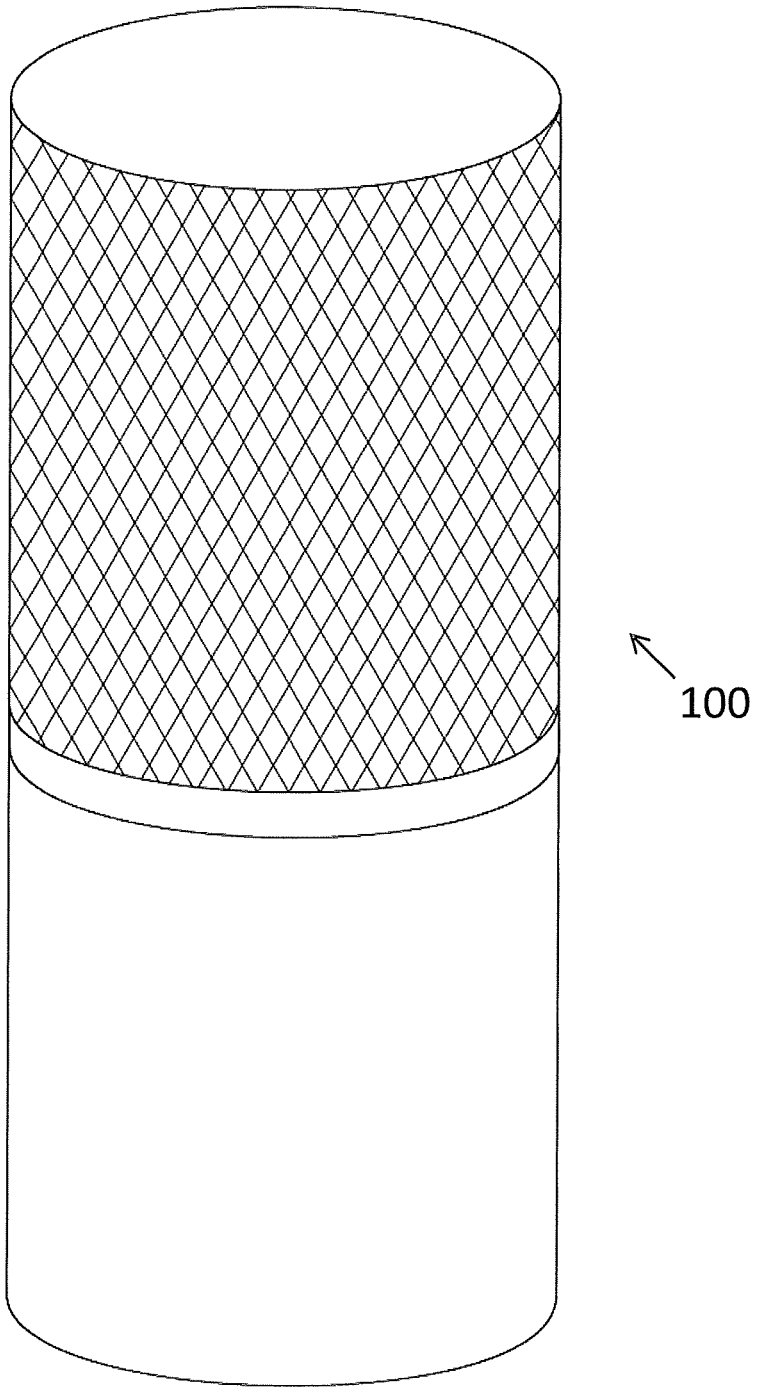
FIG. 4 shows a microphone according to the present invention.

The condenser microphone element 10 according to the present invention can be used in a condenser microphone or in other applications where high quality registration of sound waves is required. An example of a possible condenser microphone 100 including the condenser microphone element of the present invention is shown in FIG. 4.

The invention claimed is:

1. A condenser microphone element comprising:

an electrically conducting transducer membrane having an acoustically active area that is arranged to receive sound waves and to vibrate in response to said sound waves, a back plate, the membrane being arranged in parallel with and at a distance from the back plate, the back plate being formed from a non-conductive base having a conductive layer, an active area of the conductive layer arranged opposite and corresponding to the acoustically active area of the membrane and having a shape that faces said acoustically active area, and an area provided as a continuous gap in the conductive layer delimiting the active area, wherein the conductive layer is provided both outside and inside of said gap, and wherein the acoustically active area of the membrane is larger than the active area of the back plate.

2. The condenser microphone element according to claim 1, wherein the membrane is connected to ground and kept at potential 0 V.

3. A condenser microphone element comprising:

an electrically conducting transducer membrane having an acoustically active area that is arranged to receive sound waves and to vibrate in response to said sound waves, a back plate, the membrane being arranged in parallel with and at a distance from the back plate, the back plate being formed from a non-conductive base having a conductive layer, an active area of the conductive layer arranged opposite and corresponding to the acoustically active area of the membrane and having a shape that faces said acoustically active area, an area provided as a continuous gap in the conductive layer delimiting the active area, and a spacer in the form of an adhesive film attached to the upper surface of the back plate to create a distance between the active area of the back plate and the acoustically active area of the membrane, wherein the conductive layer is provided both outside and inside of said gap.

4. The condenser microphone element according to claim 1, wherein the acoustically active area of the transducer membrane has an essentially triangular shape.

5. A condenser microphone element comprising:

an electrically conducting transducer membrane having an acoustically active area that is arranged to receive sound waves and to vibrate in response to said sound waves, a back plate, the membrane being arranged in parallel with and at a distance from the back plate, the back plate being formed from a non-conductive base having a conductive layer, an active area of the conductive layer arranged opposite and corresponding to the acoustically active area of the membrane and having a shape that faces said acoustically active area, an area provided as a continuous gap in the conductive layer delimiting the active area, and an electrical connection arranged through the non-conductive base of the back plate, the electrical connection connecting the active area of the back plate to an electrical contact, wherein the conductive layer is provided both outside and inside of said clap.

6. The condenser microphone element according to claim 1, wherein the non-conductive base is formed from a rigid material from the group of materials comprising ceramics, plastics and composites.

7. The condenser microphone element according to claim 1, wherein the conductive layer is a metallic layer that includes copper.

8. A condenser microphone further comprising a condenser microphone element according to claim 1.

9. A method of producing a condenser microphone element including an electrically conducting transducer membrane having an acoustically active area arranged in parallel with and at a distance from a back plate, comprising:

forming the back plate from a non-conductive base, which is provided with a conductive layer by adding the conductive layer in form of a metal foil to a non-conductive base, forming the conductive layer with an active area delimited by a continuous area where no conductive layer is provided, arranging the active area opposite the membrane, such that the active area faces the acoustically active area of the membrane.

* * * * *